US006783016B2

(12) United States Patent
Wang

(10) Patent No.: US 6,783,016 B2
(45) Date of Patent: Aug. 31, 2004

(54) CONTAINER WITH COLLAPSIBLE LOOPS

(76) Inventor: Grace Wang, 2090 Del Rio Pl., Ontario, CA (US) 91761

( * ) Notice: Subject to any disclaimer, the term of this patent is extended or adjusted under 35 U.S.C. 154(b) by 0 days.

(21) Appl. No.: 10/113,226

(22) Filed: Mar. 29, 2002

(65) Prior Publication Data

US 2003/0183629 A1 Oct. 2, 2003

(51) Int. Cl.[7] ..... A45C 7/00
(52) U.S. Cl. ..... 220/9.2; 383/4; 383/74; 383/113
(58) Field of Search ..... 220/9.2, 666, 654; 135/126; 383/111, 113, 74, 75, 4; 2/209.11, 410, 175.4, 195.5

(56) References Cited

U.S. PATENT DOCUMENTS 618,442 A * 1/1899 Shearer ..... 220/9.2
1,658,590 A * 2/1928 Clements ..... 2/171.01
1,691,904 A * 11/1928 Gamble ..... 206/8
2,150,620 A * 3/1939 Frost ..... 220/9.2
2,530,746 A * 11/1950 Wetherby ..... 15/104.94
2,580,796 A * 1/1952 Kleiss et al. ..... 383/6
2,664,131 A * 12/1953 Miller ..... 383/12
2,721,691 A * 10/1955 Makrauer ..... 383/110
2,754,869 A * 7/1956 Bartels ..... 383/12
2,837,132 A * 6/1958 Daust ..... 150/118
5,429,437 A * 7/1995 Shaw et al. ..... 383/33
5,800,067 A * 9/1998 Easter ..... 383/104
5,964,533 A * 10/1999 Ziglar ..... 383/36
6,012,172 A * 1/2000 Steffy ..... 2/175.1
6,019,244 A * 2/2000 Jones ..... 220/666
6,260,208 B1 * 7/2001 Wang ..... 2/209.11

* cited by examiner

*Primary Examiner*—Robin A. Hyton
(74) *Attorney, Agent, or Firm*—Boniard I. Brown

(57) ABSTRACT

A collapsible container has two loops, a flexible wall web attached about and extending between the loops, and a bottom web. The loops are twistable into compact, layered array into collapsed and much smaller configuration for transport.

7 Claims, 2 Drawing Sheets

CONTAINER WITH COLLAPSIBLE LOOPS

BACKGROUND AND SUMMARY OF THE INVENTION

The present invention provides a collapsible portable container, and more particularly to such a container having collapsible loops twistable into contracted, compact configuration.

Loops having a spring characteristic and twistable into compact configurations are well known, these including vehicle windshield sunshades, and a visor of Applicant's U.S. Pat. No. 6,260,208.

The collapsible container is useful in various activites, such as sports, camping, hiking, dog-walking, etc., wherein it is useful, and sometimes necessary, to have an available container for liquid or other material, particularly at sites where water or other contents are available.

The collapsible container according to the invention comprises upper and lower loops having spring characteristics, a flexible wall secured to and extending between the loops, a bottom formed by a web extending across a lower loop, with the loops with the webs thereon being twistable into a compact layered array by the manual grasping and twisting of opposite side portions of the loops.

DESCRIPTION OF THE PREFERRED EMBODIMENTS

Figure 1:
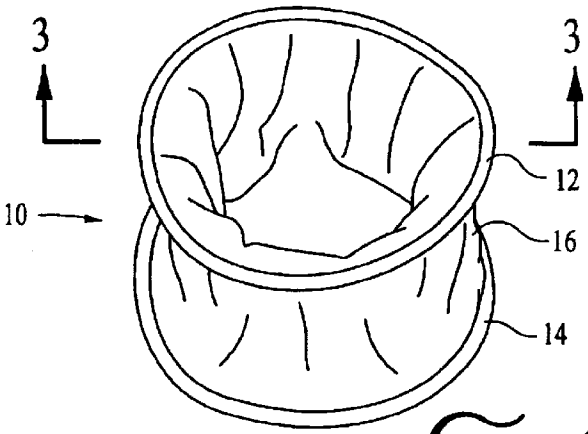
FIG. 1 is a perspective view of a preferred embodiment of the collapsible container of the invention in its expanded configuration.
Figure 2:
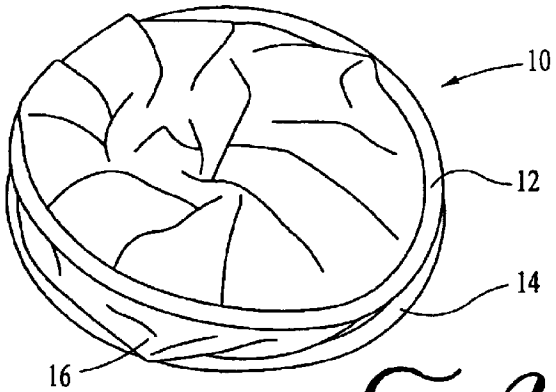
FIG. 2 is a perspective view of the embodiment of FIG. 1 in its closed configuration.

Referring to the drawings, a preferred embodiment of the collapsible container 10 of the invention comprises two closed loops 12, 14 of curvilinear configuration. A sheet or web 16 of flexible material has end portions secured about each of the loops and extends therebetween, thus cooperating to define a generally tubular assembly when extended. A liquid-tight containment web is thus secured in an unstitched liquid-tight hem about said upper first loop, and the wall web has no stitching. A second layer of flexible material (not shown) may be utilized to provide two layers of flexible material for improved strength and or further assurance against leakage of liquid therethrough.

Figure 3:
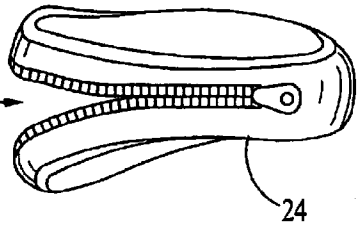
FIG. 3 is an elevational sectional view of a modified form of the invention wherein a containment web secures the top of the container and within an exterior wall web.
Figure 3:
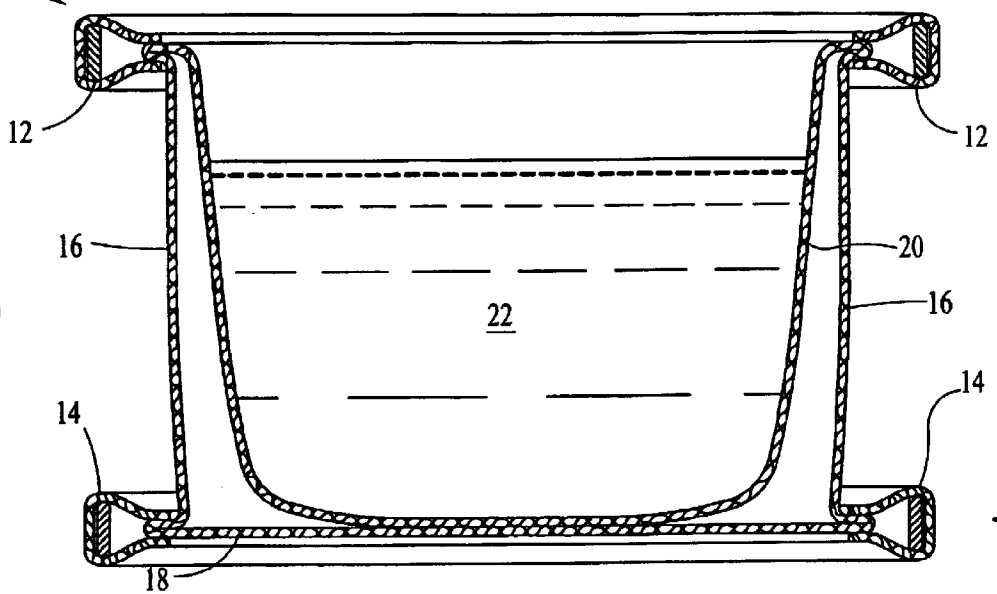

A web of sheet material 18 extends across a lower one of the loops, thus to define with the tubular arrangement provided by the web 16 extending between the loops, a container, the loops being deployable in generally expanded configuration and spaced apart, as indicated in FIGS. 1 and 3, to define a container for liquid or other contents.

FIG. 3 shows a liquid containment bowl wherein flexible fabric 20 is secured at or in the upper hem about upper loop 12, as shown, and extends to the region of a bottom wall 18, and serves to retain a liquid 22 or other contents, instead of the body of liquid being retained by the bottom wall 18. This inner containment bowl, combined with the container provided by the web 16, provides dual assurance against leakage from the container assembly.

Figure 6:
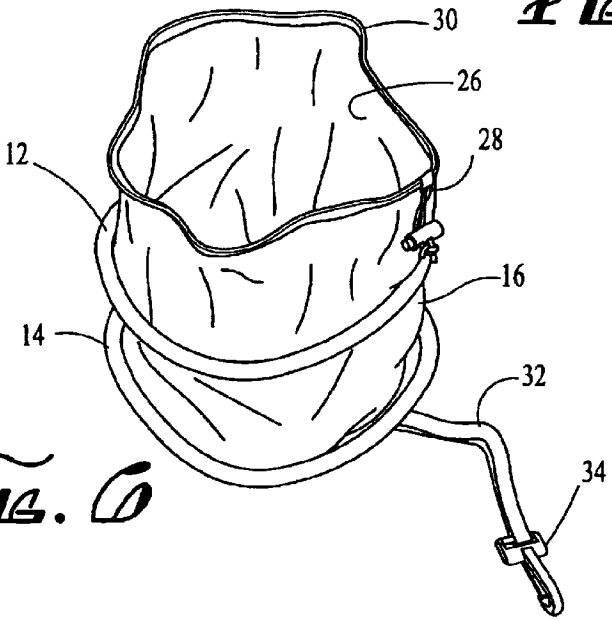
FIG. 6 is a perspective view of an embodiment of the invention having the features of the embodiment of FIG. 1 and further including an upper closure web having a hem wherein is disposed a drawstring.
Figure 4:
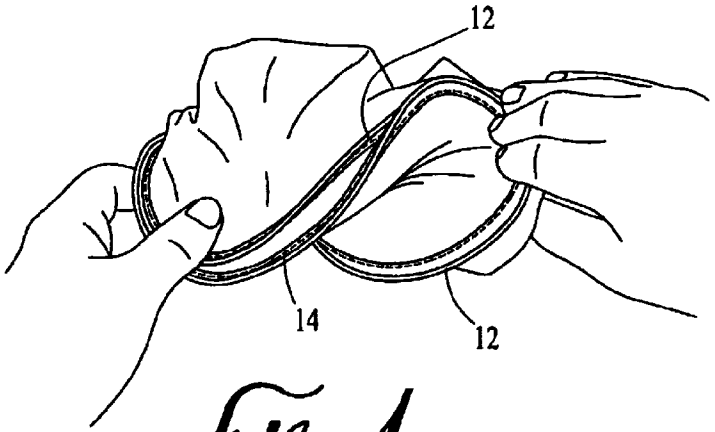
FIG. 4 is an elevational view showing the container of FIGS. 1 and 2 being twisted into a compact configuration.
Figure 5:
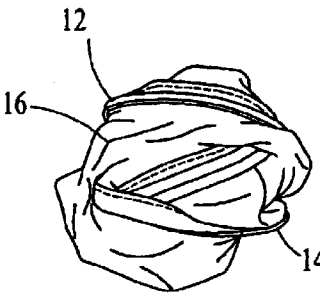
FIG. 5 shows the container of FIG. 4 in a substantially compact configuration, and further showing a small pouch for containment of the compacted container.

The container thus defined, shown in its extended configuration of FIGS. 1, 6 and 3, is collapsed or compressible from this expanded configuration into the configuration of FIG. 5 by manually grasping opposite sides of the loops, with the loops held in general registration, and twisting opposite sides of the loops toward each other, as indicated in FIG. 4. The hands are then brought together to dispose the pairs of sides in layered configuration with the loops in four generally symmetrical smaller loops in overlaid configuration. The overlaid loops may have a diameter of about one-third the diameter of the fully extended loops.

The container, collapsed or compressed in the manner described above, provides a much smaller assembly, thus enabling the carrying or storing in a much smaller space, container, or pouch 24, as indicated in FIG. 5.

Figure 7:
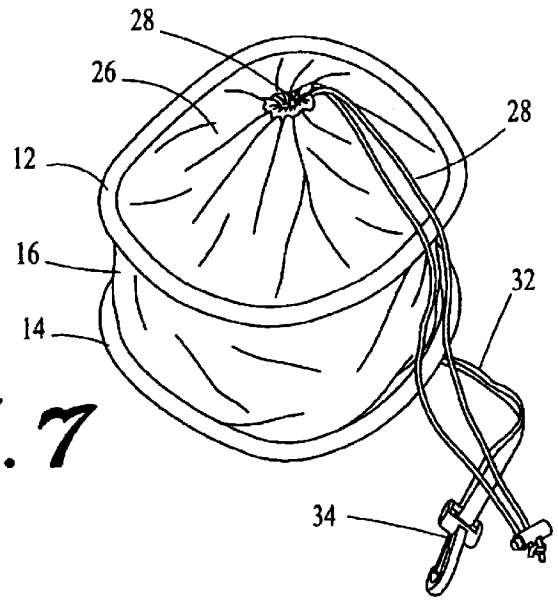
FIG. 7 is a view of the embodiment of FIG. 6 showing the closure web in closed configuration.

FIGS. 6 and 7 show a modified form of the container of the invention, wherein a web 26 is secured about and extends inwardly from the upper loop 12, as shown, and a drawstring 28 extends through a tubular passage 30 at the inner edge of the web 26 (as shown) thus to provide for the manual drawing together and substantially closing of the opening defined by the inner edge portion of the web 26. A carrying strap 32 with a snap-on clip 34 at the end thereof provides convenience of transport and handling.

Figure 8:
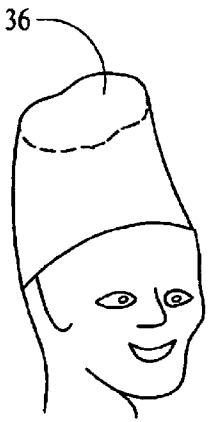
FIG. 8 shows generally a container of FIG. 1 disposed as a hat on the head of a wearer.

FIG. 8 shows a container according to the invention sized and adapted for use as a hat 36 for wear on a person's head. Such a hat version of the invention may be readily collapsed and carried in a small container such as shown at 24, as indicated in FIG. 5.

It will be understood that various changes and modifications may be made from the preferred embodiments discussed above without departing from the scope of the present invention, which is established by the following claims and equivalents thereof.

The inventor claims:

1. A collapsible container comprising:

an upper first and a second loop of generally similar configuration, a flexible wall web attached about each of said loops and extending therebetween to define a tubular assembly, a bottom web attached to and extending across the second loop and cooperating with said loops and the wall web to define a container, a hem of said wall web is disposed about each of the first and second loops, a containment web secured in said hem about the upper first loop and extends therefrom and toward the second loop to define a containment vessel for liquid and other materials, whereby the wall web and containment web provide double containment against leakage from the container, and said loops with said webs thereon being twistable from their extended configurations into a compact layered array by manual grasping an twisting of opposite side portions of both loops to twist the loops into a collapsed configuration of four generally symmetrical smaller loops in overlaid array to facilitate handling and compact storage.

2. A container according to claim 1, wherein said loops have a spring characteristic.

3. A container according to claim 1, wherein the loops are formed of one of (a) spring steel, (b) spring plastic.

4. A container according to claim 1, wherein a hem of said wall web is disposed about each of the first and second loops.

5. A container according to claim 1, adapted for containment in a compact container for carrying and storage.

6. A container according to claim 1, wherein said wall web is formed of one of (a) synthetic fabric, (b) plastic coated fabric, (c) plastic sheet, (d) stretch fabric, (e) textile.

7. A container according to claim 1, wherein said containment web has no stitching therein for assurance against leakage therethrough.

* * * * *